US008858119B2

(12) United States Patent
Wynne

(10) Patent No.: US 8,858,119 B2
(45) Date of Patent: Oct. 14, 2014

(54) LIQUID RUN-OFF DISPOSAL SYSTEM

(76) Inventor: Michael John Wynne, Osborne Park (AU)

( * ) Notice: Subject to any disclaimer, the term of this patent is extended or adjusted under 35 U.S.C. 154(b) by 0 days.

(21) Appl. No.: 13/383,777

(22) PCT Filed: Jul. 12, 2010

(86) PCT No.: PCT/AU2010/000885

§ 371 (c)(1),
(2), (4) Date: Jan. 12, 2012

(87) PCT Pub. No.: WO2011/006192

PCT Pub. Date: Jan. 20, 2011

(65) Prior Publication Data

US 2012/0107047 A1 May 3, 2012

(30) Foreign Application Priority Data

Jul. 13, 2009 (AU) ..... 2009906328
Dec. 14, 2009 (AU) ..... 2009906092

(51) Int. Cl.
*E03F 1/00* (2006.01)

(52) U.S. Cl.
CPC ..... *E03F 1/002* (2013.01)
USPC ..... 405/48; 405/43; 405/44; 405/46

(58) Field of Classification Search
USPC ..... 405/43–49
See application file for complete search history.

(56) References Cited

U.S. PATENT DOCUMENTS

| | | | | |
|---|---|---|---|---|
| 3,645,100 | A * | 2/1972 | La Monica | 405/46 |
| 3,973,407 | A * | 8/1976 | Vecchio | 210/136 |
| 4,720,209 | A | 1/1988 | Iams | |
| 5,669,733 | A | 9/1997 | Daly et al. | |
| 5,720,577 | A * | 2/1998 | Sanders et al. | 405/124 |
| 6,612,777 | B2 * | 9/2003 | Maestro | 405/49 |
| 2004/0184884 | A1 * | 9/2004 | DiTullio | 405/43 |
| 2005/0074287 | A1 | 4/2005 | Brochu et al. | |
| 2006/0182497 | A1 * | 8/2006 | Potts | 405/46 |
| 2007/0154261 | A1 * | 7/2007 | Brochu et al. | 405/43 |
| 2007/0262009 | A1 * | 11/2007 | Fitzgerald | 210/170.03 |

* cited by examiner

*Primary Examiner* — Benjamin Fiorello
*Assistant Examiner* — Kyle Armstrong
(74) *Attorney, Agent, or Firm* — Hamre, Schumann, Mueller & Larson, P.C.

(57) ABSTRACT

A liquid run-off disposal system (10) comprising an elongate tank structure (22) having one or more sections adapted to be arranged end to end in a substantially horizontal orientation below ground. The tank structure (22) also includes a plurality of apertures (14) provided in the side walls thereof wherein, in use, when liquid run-off is piped into the tank structure (22) it can drain away by soaking into the surrounding soil.

19 Claims, 7 Drawing Sheets

LIQUID RUN-OFF DISPOSAL SYSTEM

FIELD OF THE INVENTION

The present invention relates to a liquid run-off disposal system and relates particularly, though not exclusively, to such a disposal system for disposing of stormwater run-off.

BACKGROUND TO THE INVENTION

In Perth, Western Australia, because of the generally sandy soil, one of the most common methods for disposing of stormwater is to employ soakwells. A typical soakwell consists of a cylindrical section that is installed in a vertical orientation in the soil. It may have a plurality of apertures provided in the side wall, and it is open at the bottom so that when water collects in the soakwell it can soak into the surrounding soil underneath. Downpipes connected to drains from roof guttering are plumbed into the side wall of the soakwell so that stormwater run-off is safely directed and disposed of away from building foundations. Soakwells may also directly collect rainwater run-off from car park areas.

One of the problems with soak wells is their limited capacity. This means that the larger the impervious surface area that a building or development has requiring drainage of stormwater run-off, the more soakwells have to be installed. However installing soakwells is labour-intensive and expensive, as each soakwell first requires excavation of the soil at numerous locations over the site and then craning of the concrete cylinder into the excavated hole at many locations.

The present invention was developed with a view to providing a liquid run-off disposal system that is fully scalable, and simple, compact and easy to install compared to soakwells.

References to prior art in this specification are provided for illustrative purposes only and are not to be taken as an admission that such prior art is part of the common general knowledge in Australia or elsewhere.

SUMMARY OF THE INVENTION

According to one aspect of the present invention there is provided a liquid run-off disposal system comprising:

an elongate tank structure having one or more sections adapted to be arranged end to end in a substantially horizontal orientation below ground, and having a plurality of apertures provided in the side walls thereof wherein, in use, when liquid run-off is piped into the tank structure it can drain away by soaking into the surrounding soil.

Advantageously the apertures are louvre-shaped so as to admit the exit of water but substantially inhibit the entry of soil. Preferably the louvre-shaped apertures are of generally rectangular shape and comprise an upper surface and a lower surface. Alternatively the louvre-shaped apertures could be cylindrical in shape. Preferably the upper surface and the lower surface of the louvre-shaped apertures are substantially parallel to each other and are angled downwards from the inside to the outside of the tank structure. Advantageously the upper and lower surfaces are angled at such an angle, and are of a length, so as to substantially overlap in a horizontal direction.

Throughout the specification the term "tank structure" refers to a hollow structure adapted to temporarily store liquid underground and which may be open or closed at the base. The tank structure typically has an end wall at each end, in use, so as to form an enclosed below-ground tank or tunnel. In one embodiment of the invention each section of the tank structure takes the form of a culvert section.

Preferably each culvert section is of generally rectangular cross-section but the shape could take other forms such as rounded tops and sides having a curvature dependant on the scale, particular manufacturing materials used, and the application to which the design is applied. Each culvert section typically has an open base. Preferably each culvert section could also be generally cylindrical in shape with louvre-shaped apertures and/or cylindrical shaped apertures in the bottom half of the cylinder. Preferably each culvert section or other such shape which suits an application on site and the site conditions is of elongate construction forming a straight section or varying shapes, L-shaped, U-shaped, rectangular and so on depending on site sizes and conditions and the scale of the design for a project. The liquid run-off disposal system can be used as a central collection point other than building sites such as major road and infrastructure projects by Governments and Local Council's drainage pits. Preferably each culvert section has interlocking edges provided at each end adapted to interlock with an adjoining culvert section. Typically each culvert section is manufactured from suitable materials. Depending on the design requirements, concrete footings for the culvert sections are preferably provided in an excavated trench prior to installation of the liquid run-off disposal system where it would be subject to heavy vehicular traffic.

Preferably the liquid run-off disposal system further comprises two end wall panels for closing each end of the culvert sections, in use, so as to form an enclosed below-ground tank or tunnel.

Preferably the liquid run-off disposal system further comprises one or more vertical liners arranged at predetermined locations on top of the culvert sections for maintenance purposes. Preferably the liner is provided with a manhole cover or a grating for back-pressure relief and to collect stormwater from sealed surfaces other than a building. Alternatively, the manhole, grating or access chambers may be the normal drainage soakwells or gully pits in the car park areas of a development with the stormwater cylindrical tanks system installed between these manhole/access chambers.

Each culvert section may further comprise one or more vertically oriented elongate drain pipes which are mounted inside each culvert section. Each drain pipe is preferably of hollow cylindrical cross-section and has an opening at the bottom end which connects to a drain hole provided in the floor of the culvert section. The opening at the bottom end of the drain pipe is preferably provided with a one-way valve for inhibiting the reverse flow of liquid through the drain hole back into the culvert section. Preferably each drain pipe is provided with a series of apertures at spaced intervals about its circumference and along its length whereby, in use, any liquid which accumulates in the lower half of the culvert section is allowed to drain away in a controlled manner through the drain hole in the floor of the culvert section.

Throughout the specification, unless the context requires otherwise, the word "comprise" or variations such as "comprises" or "comprising", will be understood to imply the inclusion of a stated integer or group of integers but not the exclusion of any other integer or group of integers. Likewise the word "preferably" or variations such as "preferred", will be understood to imply that a stated integer or group of integers is desirable but not essential to the working of the invention.

BRIEF DESCRIPTION OF THE DRAWINGS

The nature of the invention will be better understood from the following detailed description of several specific embodiments of the liquid run-off disposal system, given by way of example only, with reference to the accompanying drawings, in which.

DETAILED DESCRIPTION OF PREFERRED EMBODIMENTS

Figure 1C:
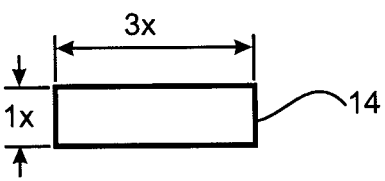
FIG. 1*c* is an enlarged view of an aperture 14 of the first embodiment shown in FIG. 1*a;*

A first embodiment of a liquid run-off disposal system 10 in accordance with the invention, as illustrated in FIGS. 1 and 2, comprises a plurality of culvert sections 12 adapted to be arranged end to end in a substantially horizontal orientation so as to form an elongate tank structure 22 below ground. Each culvert section 12 has a plurality of apertures 14 provided in the side walls thereof wherein, in use, when stormwater run-off is piped into the culvert sections 12 or enters through the grating 32 on top of the vertical liners, it can drain away by soaking into the surrounding soil.

Figure 2B:
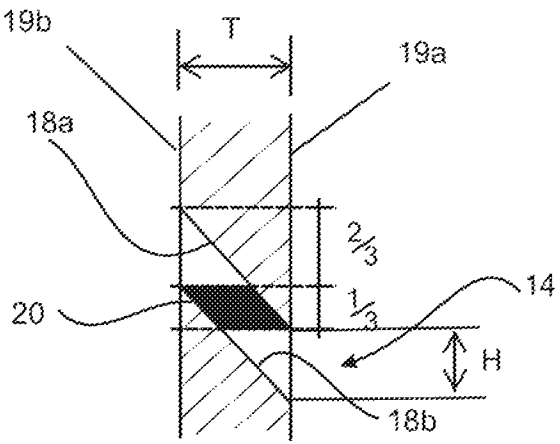
FIG. 2*b* is a detail enlargement of a cross-section of one of the louvre-shaped apertures in the side walls of the culvert section of FIG. 2*a;*
Figure 2A:
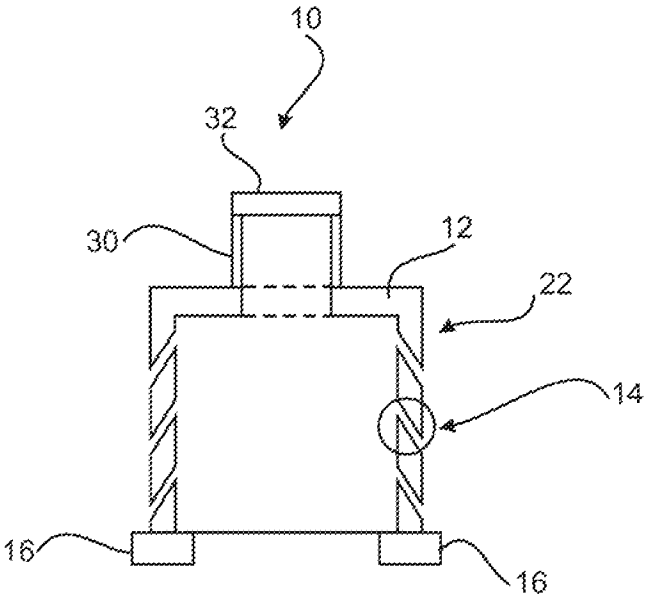
FIG. 2*a* is a cross-section view of a culvert section employed in the liquid run-off disposal system of FIG. 1*a;*

In this embodiment each culvert section 12 is of generally rectangular cross-section and is typically open at the base, as can be seen most clearly in FIG. 2*a*. Although the following description will be given primarily with reference to systems for the disposal of stormwater run-off, it will be understood that the same systems could also be used in appropriate situations for the disposal of other types of liquid run-off.

It can be seen how the culvert sections 12 thus perform a similar function to a prior art soakwell, in that stormwater run-off can drain away into the surrounding soil through the open base and the apertures 14 in the side walls. However, unlike a soakwell, the liquid run-off disposal system 10 is scalable in that any number of the culvert sections 12 can be joined end to end to increase the capacity of the system longitudinally rather than horizontally, the latter being far more costly when installed. This scalability also overcomes the requirement of soakwells having to be a minimum of 1800 mm apart, thereby saving space on site. Furthermore the height, length and width of the culvert sections 12 can be varied more readily to suit the application and achieve the required volume capacity.

Figure 1B:
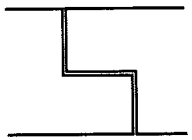
FIG. 1*b* is a detail enlargement of the interlocking arrangement of the culvert section sections in the system of FIG. 1*a;*

Preferably each culvert section 12 is of elongate construction and has interlocking edges provided at each end adapted to interlock with an adjoining culvert section 12, as shown in FIG. 1*b*. In the illustrated embodiment each culvert section 12 is shown as manufactured from concrete, however it will be understood that other materials may be employed. Preferably concrete footings 16 for the culvert sections 12 are provided in an excavated trench prior to installation of the liquid run-off disposal system 10 which may be subject to heavy vehicular traffic.

Advantageously the apertures 14 are louvre-shaped so as to admit the exit of water but substantially inhibit the entry of soil into the culvert section. Preferably the louvre-shaped apertures 14 are of generally rectangular shape and comprise an upper surface 18*a* and a lower surface 18*b*. Preferably the upper surface 18*a* and the lower surface 18*b* of the louvre-shaped apertures 14 are substantially parallel to each other and are angled downwards from the inside to the outside of the culvert section 12, as can be seen most clearly in FIG. 2*a*. Advantageously the upper and lower surfaces 18 are angled at such an angle, and are of a length, so as to substantially overlap in a horizontal direction, as shown by the shaded area 20 in FIG. 2*b*. Preferably about one third of the length of the respective surfaces 18*a* and 18*b* overlap, measured in a vertical direction. The number, shape and size of the louvre-shaped apertures 14 may be varied to suit the size of the application for which the system 10 is designed.

As shown in FIG. 2*b*, in a cross-sectional view, the side walls of the culvert section include an outer or exterior surface 19*a* and an inner or interior surface 19*b*. Each of the sidewalls has a substantially constant thickness T defined between the surfaces 19*a*, 19*b*. In addition, each of the apertures 14 have the same height H in cross-sectional view measured between the upper surface 18*a* and the lower surface 18*b* at the surface 19*a*. Since the upper surface 18*a* and the lower surface 18*b* are substantially parallel to one another, the height H of the apertures 14 is also the same at the surface 19*b*.

In the event that the tank structure 22 were to fill with stormwater run-off and then drain via the base and sides, within a suitable time frame, a positive pressure may be formed within the hollow interior of the tank structure 22. The positive pressure of liquid entering a conventional soakwell forces the lid/cover to an unvented soakwell to dislodge and is forced upwards which immediately relieves the positive pressure but causes the immediate reverse situation within the soakwell, in that a negative pressure follows on the side walls which tends to draw the surrounding backfill materials into the hollow interior of the soakwell via the usual conventional apertures. This would not only cause the conventional soakwell to become clogged and ineffective, but may also result in the collapsing or sagging of surface cover in a carpark or other surrounding surfaces. However the angled arrangement and the design of the louvre-shaped apertures 14 in the case of the tank structure 22 substantially prevent such occurrences by inhibiting the ingress of soil or other backfill materials into the hollow interior of the tank structure 22 which at predetermined points has been provided with integral back pressure relief outlets.

Figure 1A:
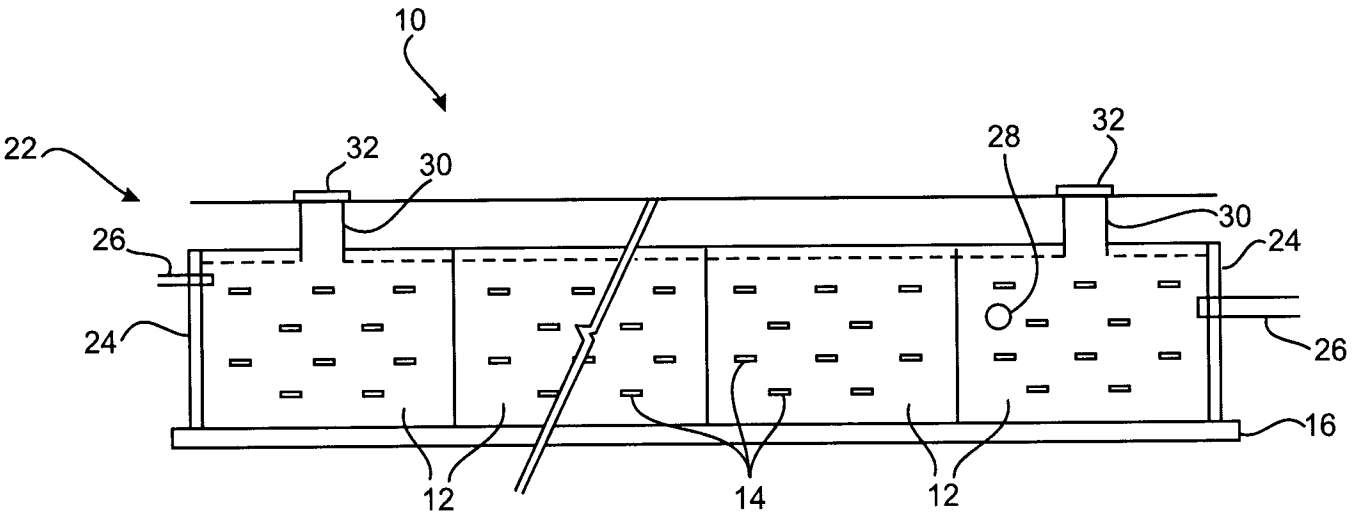
FIG. 1*a* is a side elevation of a first embodiment of a liquid run-off disposal system according to the present invention.

Preferably the liquid run-off disposal system 10 further comprises two end wall panels 24 for closing each end of the plurality of culvert sections 12, in use, so as to form an enclosed below-ground box section or tunnel section tank structure. The end wall panels 24 are typically also preferably manufactured from the same material. Preferably the end wall panels 24 will have one or more inlet holes provided therein for receiving respective inlet drainage pipes 26. The inlet drainage pipes 26 can vary in diameter and invert levels. Furthermore it is possible to have multiple connections at each end of the tank structure 22 or through the side walls. An alternate drainage pipe entry point 28 through a side wall of a culvert section 12 is shown in FIG. 1*a*.

Preferably the liquid run-off disposal system further comprises one or more vertical liners 30 arranged at predetermined locations on top of the plurality of culvert sections 12 for maintenance purposes. Preferably each liner 30 is provided with a manhole cover 32 or a grating for back-pressure relief and to collect stormwater from sealed surfaces other than a building. In the illustrated embodiment the liners 30 are cylindrical but may take other shapes depending on the design and project to which the systems are applied, and are of a height required to suit the depth of the application. Larger diameter liners 30 may also be employed if required. Preferably internal step irons or a ladder is provided in accordance with OHS requirements. The liners 30 permit maintenance workers to enter the hollow interior of the culvert sections 12 for cleaning or repair work. Alternatively, or in addition thereto, an air relief grated lid may be fitted to the liner 30 or in the top or wall sections of the tank structure 22 to provide relief from back-pressure, and to collect stormwater run-off from sealed surfaces other than a building.

Figure 3:
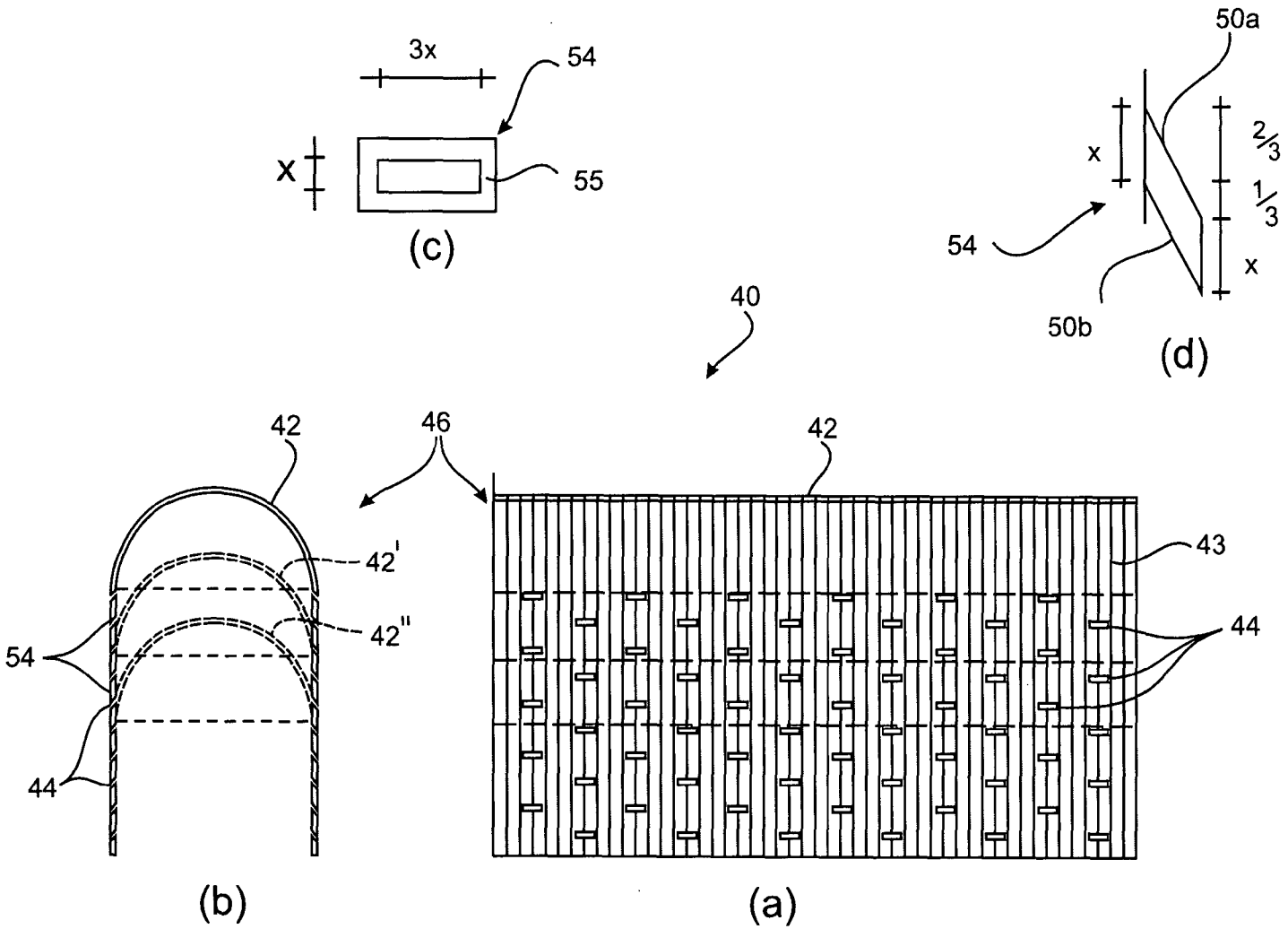
FIG. 3*a* is a side elevation of a section of a second embodiment of a liquid run-off disposal system according to the present invention.
FIG. 3*b* is an end elevation of the section of FIG. 3*a;*
FIG. 3*c* is an enlarged plan view of a louvre-shaped insert employed in the section of FIG. 3*a;*
FIG. 3*d* is an enlarged side elevation of a louvre-shaped insert employed in the section of FIG. 3*a;*
Figure 4:
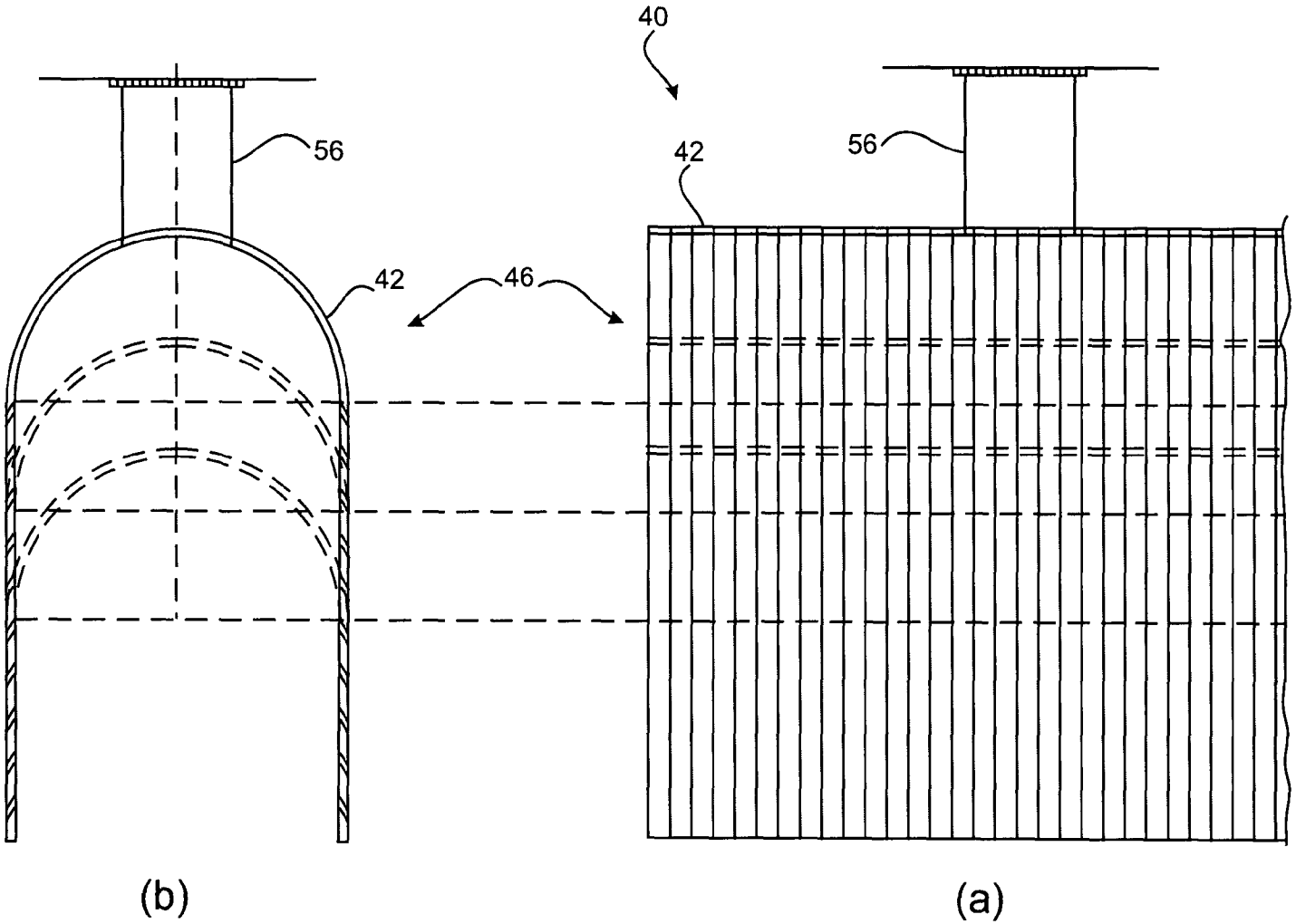
FIG. 4*a* is a side elevation of a section of the liquid run-off disposal system of FIG. 3*a* with an access chamber.
FIG. 4*b* is an end elevation of the section of FIG. 4*a;*

A second embodiment of a liquid run-off disposal system 40 in accordance with the invention is illustrated in FIGS. 3 and 4. As with the previous embodiment the system 40 comprises a plurality of sections 42 adapted to be arranged end to end in a substantially horizontal orientation so as to form an elongate tank structure 46 below ground. Each section 42 has a plurality of apertures 44 provided in the side walls thereof wherein, in use, when liquid run-off is piped into the sections 42 it can drain away by soaking into the surrounding soil. In this embodiment each section is in the form of a tunnel of generally upside down U-shaped cross-section and is typically open at the base, as can be seen most clearly in FIGS. 3*b* and 4*b*.

It can be seen how the tunnel sections 42 thus perform a similar function to a prior art soakwell, in that stormwater run-off can drain away into the surrounding soil through the open base and the apertures 44 in the side walls. However, unlike a soakwell, the liquid run-off disposal system 40 is scalable in that any number of the tunnel sections 12 can be joined end to end to increase the capacity of the system. Furthermore, as with the previous embodiment, the height, length and width of the tunnel sections 42 can be varied more readily to suit the application and achieve the required volume capacity. The broken line outlines in FIGS. 3 and 4 illustrate two smaller tunnel sections 42' and 42" of reduced height. The tunnel sections 42 may also be of increased or decreased diameter to vary the volume capacity of the tank structure 46.

In this embodiment the tunnel sections 42 are preferably manufactured from extruded high density polyethylene (HDPE). Vertically extending ribs 43 or other such strengthening systems provide increased strength and rigidity for the walls of the tunnel sections 42. Galvanised hexagonal bolts and nuts drilled through rib sections are employed to join the tunnel sections 42 end to end. Alternatively, the tunnel sections 42 are heat-welded together on site according to application. Stormwater pipe lines (not shown) for carrying run-off into the tank structure 46 can vary in diameter and may also vary in depth to entry. Pipes can enter through side walls or end walls of the tank structure 46. HDPE spigots can be factory welded if known prior to installation, or drilled/cored on site to engineer's specifications. Engineer designed end panels (not visible) made of HDPE are welded to each end of the tank structure 46 to form the end walls.

As with the first embodiment, the apertures 44 are louvre-shaped so as to admit the exit of liquid but substantially inhibit the entry of soil into the tunnel sections 42. Preferably the louvre-shaped apertures 44 are of generally rectangular shape and comprise an upper surface 48*a* and a lower surface 48*b* (not visible). Preferably the upper surface 48*a* and the lower surface 48*b* of the louvre-shaped apertures 44 are substantially parallel to each other and are angled downwards from the inside to the outside of the tunnel sections 42. Advantageously the upper and lower surfaces 48 are angled at such an angle, and are of such a length, so as to substantially overlap in a horizontal direction. Preferably between one quarter to one half of the length of the respective surfaces 48*a* and 48*b* overlap, measured in a vertical direction.

The number, shape and size of the louvre-shaped apertures 44 may be varied to suit the size of the application for which the system 40 is designed. Each louvre-shaped aperture 44 is preferably dimensioned with the width being twice the depth ie 2× wide to 1× deep. Typically each louvre-shaped aperture 44 is of dimension about 100 mm wide and 50 mm deep. The upper and lower surfaces 48 may be formed on upper and lower walls 50, which together with side walls 52, form a louvre-shaped insert 54, which may be mass-produced from injection moulded HDPE as a separate component. The louvre-shaped inserts 54 have a flange 55 (see FIG. 3*c*) which is fused or welded to the inside of the tunnel sections 42 in pre-cut apertures, as shown in FIG. 3*b*.

Preferably the liquid run-off disposal system 40 further comprises one or more vertical liners 56 arranged at predetermined locations on top of the tunnel sections 42 for maintenance purposes, as shown in FIG. 4. The liner 56 is welded to the top of a tunnel section 42, which has a suitable opening cut into the top to provide access into the hollow interior of the tank structure 46. Preferably each liner 56 is provided with a manhole cover or a grating for back-pressure relief and to collect stormwater run-off from sealed surfaces other than a building. In the illustrated embodiment the liners 56 are cylindrical but may take other shapes depending on the design and project to which the systems are applied, and are of a height required to suit the depth of the application. The vertical liners 56 provide maintenance workers access to the hollow interior of the tunnel sections 42 for cleaning or repair work. Alternatively, the manhole, grating or vertical liners may be the normal drainage soakwells or gully pits in the car park areas of a development with the stormwater cylindrical tanks system installed between these manhole/vertical liners.

Figure 5:
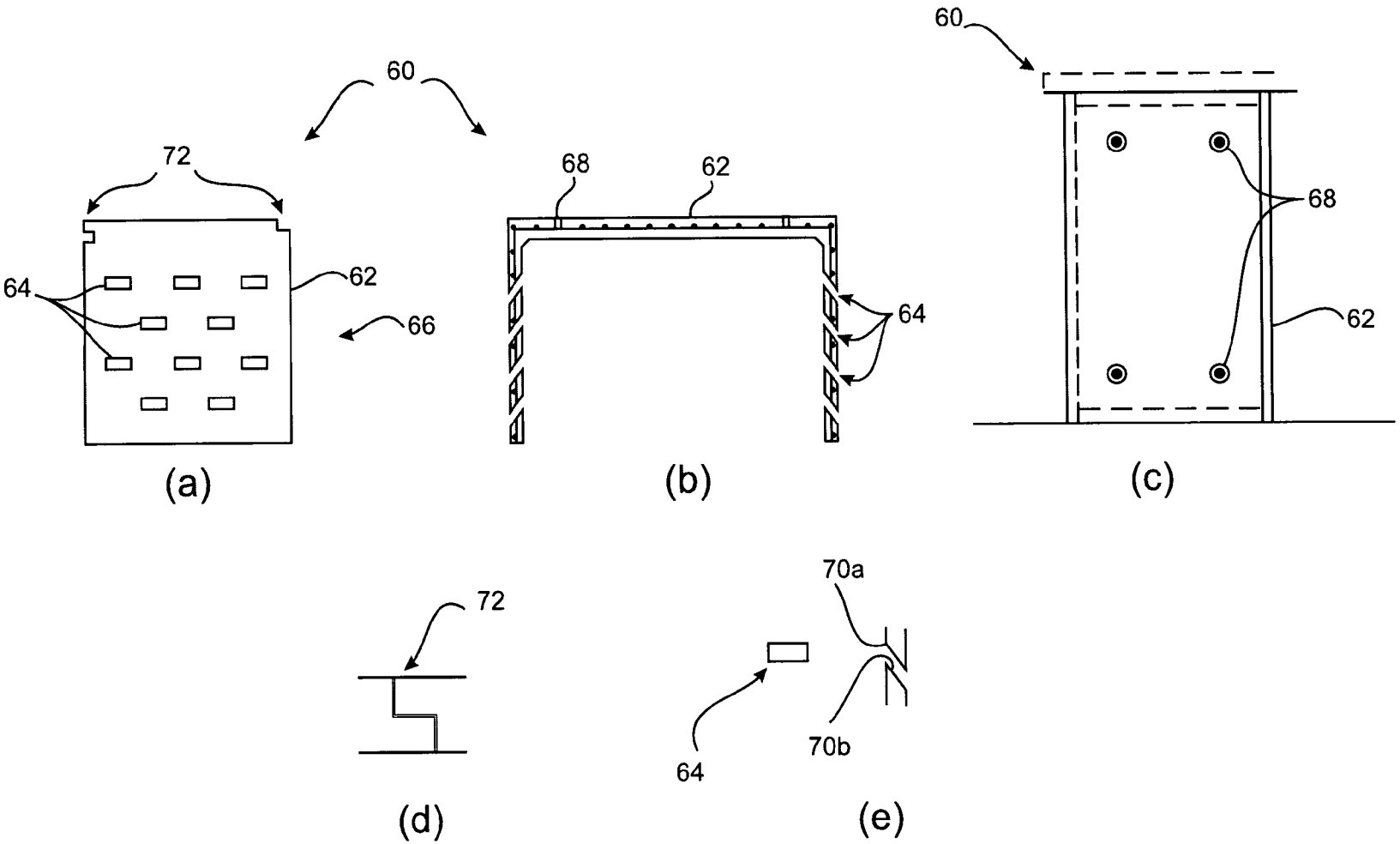
FIG. 5*a* is a side elevation of a section of a third embodiment of a liquid run-off disposal system according to the present invention.
FIG. 5*b* is an end elevation of the section of FIG. 5*a;*
FIG. 5*c* is a plan view of the section of FIG. 5*a;*
FIG. 5*d* is a detail view of an interlocking arrangement on the section of FIG. 5*a;*
FIG. 5*e* is a detail plan view and section view of one of the louvre-shaped apertures in the side wall of the section of FIG. 5*a;*
Figure 6:
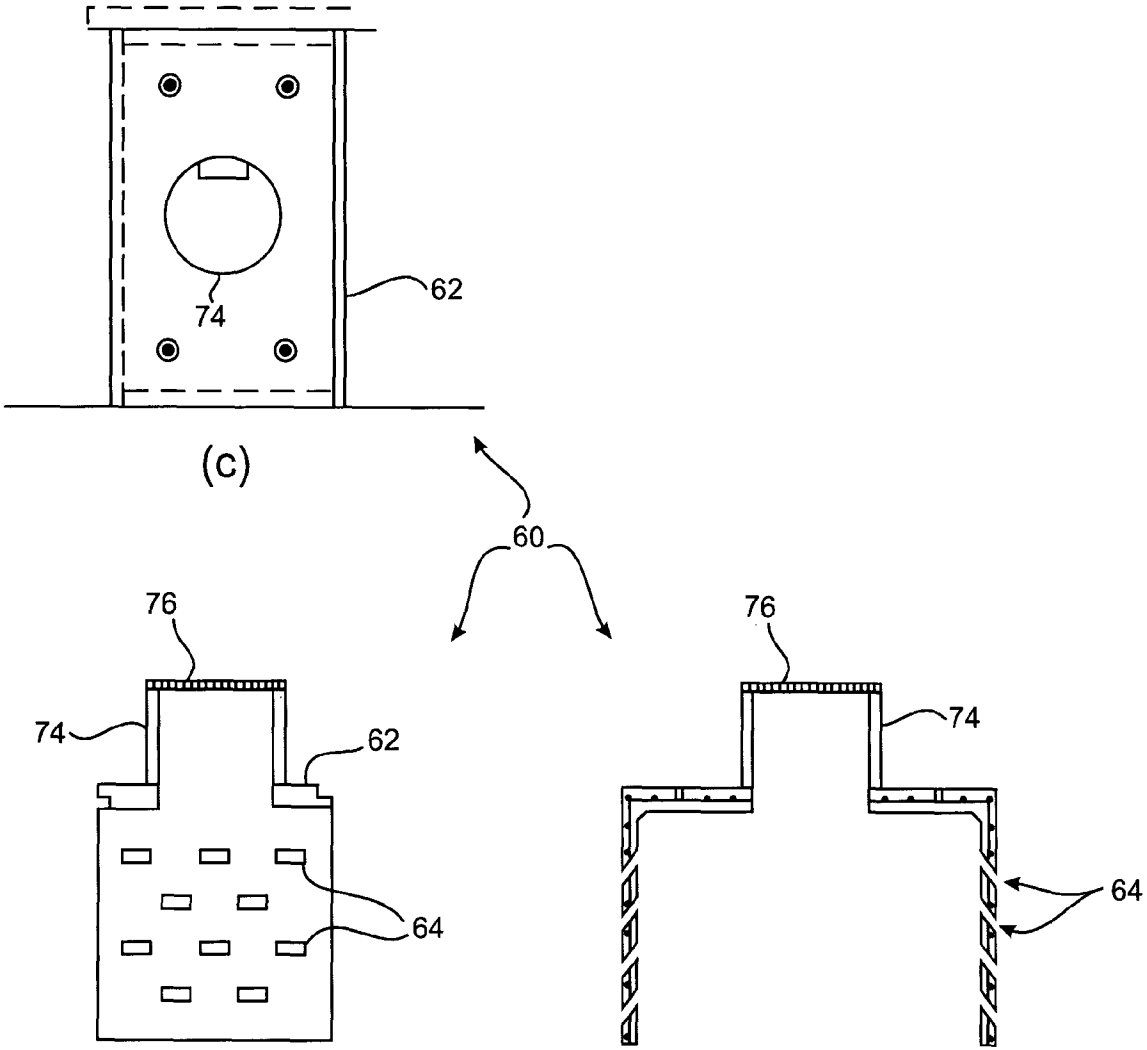
FIG. 6*a* is a side elevation of a section of the liquid run-off disposal system of FIG. 5*a* with an access chamber.
FIG. 6*b* is an end elevation of the section of FIG. 6*a;*
FIG. 6*c* is a plan view of the section of FIG. 6*a;*

A third embodiment of a liquid run-off disposal system 60 in accordance with the invention is illustrated in FIGS. 5 and 6. As with the previous embodiments the system 60 comprises a plurality of sections 62 adapted to be arranged end to end in a substantially horizontal orientation so as to form an elongate tank structure 66 below ground. Each section 62 has a plurality of apertures 64 provided in the side walls thereof wherein, in use, when run-off is piped into the sections 62 it can drain away by soaking into the surrounding soil. In this embodiment each section 62 is in the form of a box-shaped culvert and is typically open at the base, as can be seen most clearly in FIGS. 5*b* and 6*b*.

It can be seen how the culvert sections 62 thus function in a similar manner to the culvert sections 12 of the first embodiment, and therefore their operation will not be described again in detail. Each culvert section 62 of this embodiment is manufactured from concrete, reinforced with steel mesh, and has a plurality of rectangular louvre-shaped apertures 64 formed in the side walls thereof in a uniform rectangular array, as can be seen most clearly in FIG. 5*a*. A plurality of lifting lugs 68 are provided on the top of the culvert section 62 to permit it to be easily lifted and manoeuvred into position with a crane. Each culvert section 62 of this embodiment has an internal width of approximately 1.9 m and an internal height of approximately 1.0 m.

As with the previous embodiments, the apertures 64 are louvre-shaped so as to admit the exit of liquid but substantially inhibit the entry of soil into the culvert sections 62. Preferably the louvre-shaped apertures 64 are of generally rectangular shape and comprise an upper surface 70*a* and a lower surface 70*b* (see detail in FIG. 5*e*). The design and function of the louvre-shaped apertures 64 is similar to the design and function of the louvre-shaped apertures 14 of the first embodiment, and will not be described again here.

Preferably each culvert section 62 is of rectangular construction and has interlocking edges 72 provided at each end adapted to interlock with an adjoining culvert section 62, as shown in FIG. 5*d*. Preferably the liquid run-off disposal system further comprises one or more vertical liners 74 arranged at predetermined locations on top of the culvert sections 62, as shown in FIG. 6. Preferably each liner 74 is provided with a manhole cover 76 or a grating for back-pressure relief and to collect stormwater run-off. Once again, in this embodiment the liners 74 are cylindrical but may take other shapes depending on the design and project to which the systems are applied, and are of a height required to suit the depth of the application.

Figure 7:
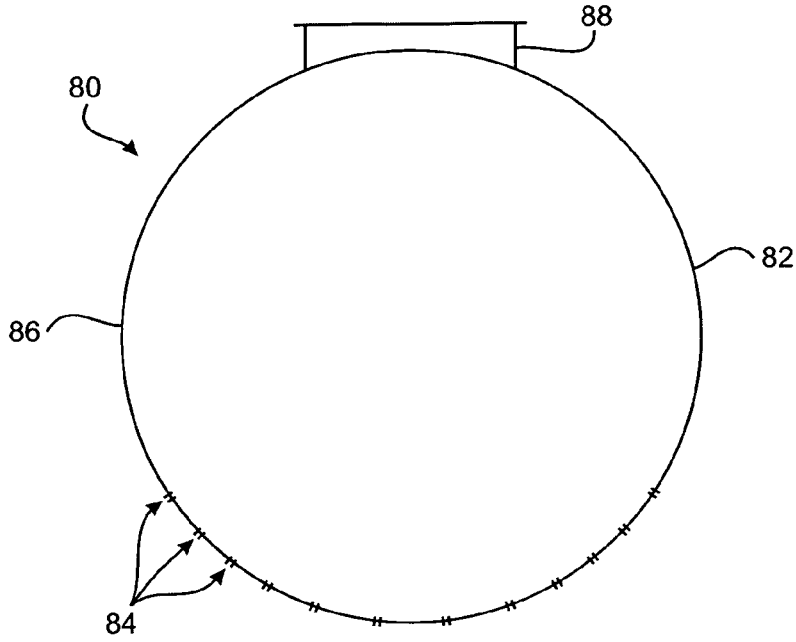
FIG. 7 is an end elevation of a fourth embodiment of a liquid run-off disposal system according to the present invention.

A fourth embodiment of a liquid run-off disposal system 80 in accordance with the invention is illustrated in FIG. 7. As with the previous embodiments the system 80 comprises a plurality of culvert sections 82 adapted to be arranged end to end in a substantially horizontal orientation so as to form an elongate tank structure 86 below ground. Each culvert section 82 has a plurality of apertures 84 provided in the side walls thereof wherein, in use, when run-off is piped into the sections 82 it can drain away by soaking into the surrounding soil. Preferably the plurality of apertures 84 are provided in the side walls at a height lower than the centreline of the culvert section. In this embodiment each section 82 is in the form of a cylindrical culvert and is typically of circular cross-section.

The apertures 84 of this embodiment are typically cylindrical shaped apertures provided in the bottom section of the cylindrical culvert. Liquid run-off flowing into the system 80 can drain into the soil through apertures 84. Preferably the liquid run-off disposal system 80 further comprises one or more vertical liners 88 arranged at predetermined locations on top of the culvert sections 82, as shown in FIG. 7. The liners 88 are similar to that previously described and will not be described again here.

Figure 8A:
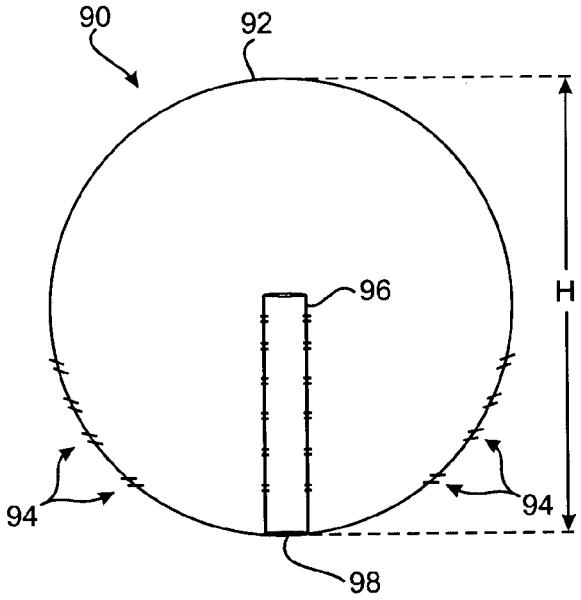
FIG. 8*a* is an end elevation of a fifth embodiment of a liquid run-off disposal system according to the present invention; and, FIG. 8*b* is an enlarged view of part of the system of FIG. 8*a*.
Figure 8B:
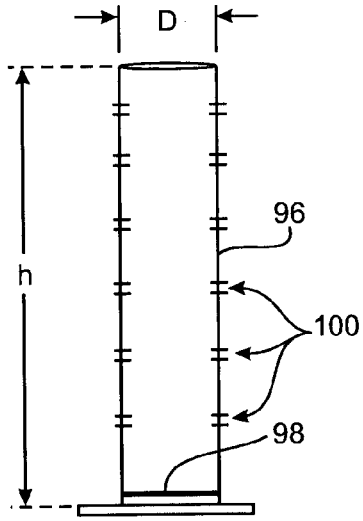

A fifth embodiment of a liquid run-off disposal system 90 in accordance with the invention is illustrated in FIG. 8. Once again the system 90 comprises a plurality of culvert sections 92 adapted to be arranged end to end in a substantially horizontal orientation so as to form an elongate tank structure below ground. Each culvert section 92 has a plurality of apertures 94 provided in the side walls thereof wherein, in use, when run-off is piped into the sections 92 it can drain away by soaking into the surrounding soil. In this embodiment each section 92 is in the form of a cylindrical culvert and is typically of circular cross-section. The apertures 94 are preferably arranged at spaced intervals along the lower half of the side walls of each section 92.

As with the previous embodiments, the apertures 94 are preferably louvre-shaped so as to admit the exit of liquid but substantially inhibit the entry of soil into the culvert sections 92. The design and function of the louvre-shaped apertures 94 is similar to the design and function of the louvre-shaped apertures 14 of the first embodiment, and will not be described again here.

Preferably this embodiment of the liquid disposal system 90 further comprises one or more vertically oriented elongate drain pipes 96 which are mounted inside each culvert section 92. Each drain pipe 96 is of hollow cylindrical cross-section and has an opening at the bottom end which connects to a drain hole provided in the floor of the culvert section 92. Preferably the opening at the bottom end of the drain pipe is provided with a one-way valve 98 for inhibiting the reverse flow of liquid through the drain hole back into the culvert section 92, for example, in soil subject to a rising water table. The drain pipe 96 is provided with a series of apertures 100 at spaced intervals about its circumference and along its length. The apertures 100 allow any liquid which accumulates in the lower half or bottom of the cylindrical culvert sections 92 to drain away in a controlled manner through the drain hole in the floor of the culvert. In use, any liquid which accumulates in the lower half of the culvert section is allowed to drain away in a controlled manner through the louvre-shaped apertures in the culvert section, which may be the normal drainage soakwells or gully pits in the car park areas of a development with the stormwater cylindrical tanks system installed between these manhole/access chambers.

Now that several embodiments of the liquid run-off disposal system have been described in detail, it will be apparent that the described embodiments provide a number of advantages over the prior art, including the following:

(i) Each of the embodiments is fully scalable in that the number of sections as well as the shape, height, length and width of the sections can be varied to suit the application.

(ii) The scalability of the system can provide for greater land use by developers and local councils as it can do away with age old system designs such as compensating basins in subdivisions.

(iii) The elongated tank structure takes up less space on site to achieve improved capacities for storage over soakwells.

(iv) The louvre-shaped apertures, in particular together with their downward angle, obviate the need for the use of geotech cloth to prevent the ingress of most soil types.

(v) The culvert sections are simple and easy to install, and can be installed more quickly and inexpensively, compared to prior art soakwells.

(vi) The excavated material from the installation of the present system is easily quantifiable for reuse by earthmovers.

(vii) The sections may be readily mass-produced from various materials, thus reducing manufacturing costs.

(viii) The sections are condensed into less physical space on site than conventional soakwells, and therefore provide a much greater storage capacity over a similar area to conventional soakwells which must be placed 1800 mm apart to have effective soakage capabilities.

It will be readily apparent to persons skilled in the relevant arts that various modifications and improvements may be made to the foregoing embodiments, in addition to those already described, without departing from the basic inventive concepts of the present invention. For example, although in the illustrated embodiments the sections generally only have apertures provided on selected portions of the side walls, it will be understood that the number, distribution and spacing of the apertures may be varied considerably from that shown. Therefore, it will be appreciated that the scope of the invention is not limited to the specific embodiments described.

The invention claimed is:

1. A liquid run-off disposal system comprising:

an elongate tank structure having one or more sections adapted to be arranged end to end in a substantially horizontal orientation below ground, each section of the tank structure taking the form of a culvert section of generally rectangular cross-section having first and second substantially vertically oriented side walls; in cross-sectional view the first and second side walls each include an inner surface and an outer surface, and the first and second side walls each have a substantially constant thickness measured between the respective inner surface and outer surface;

the first and second constant thickness side walls each include a plurality of apertures provided therein, each of the apertures being louvre-shaped and in cross-sectional view each aperture includes an upper surface and a lower surface which are substantially parallel to each other and are angled downwards from the inner surface to the outer surface, and for each aperture the distance between the upper surface and the lower surface at the outer surface is the same so that each of the apertures have substantially the same height at the outer surface, and the upper and lower surfaces are angled at such an angle and are of a length so as to substantially overlap in a horizontal direction, and for each aperture between one quarter to one half of the length of the respective upper and lower surfaces overlap measured in a vertical direction so as to admit the exit of water but substantially inhibit the entry of soil wherein, in use, when liquid run-off is piped into the tank structure it can drain away by passing through the apertures and soaking into the surrounding soil.

2. The liquid run-off disposal system as defined in claim 1, wherein about one third of the length of the respective upper and lower surfaces overlap, measured in a vertical direction.

3. The liquid run-off disposal system as defined in claim 1, wherein the louvre-shaped apertures are provided in a uniform rectangular array comprising a plurality of rows and columns, the apertures in each row being arranged at spaced intervals, and the apertures in any row being offset horizontally from the apertures in an adjacent row.

4. The liquid run-off disposal system as defined in claim 3, wherein the louvre-shaped apertures are of generally rectangular shape when viewed from a frontal viewpoint.

5. The liquid run-off disposal system as defined in claim 3, wherein the louvre-shaped apertures are cylindrical in shape when viewed from a frontal viewpoint.

6. The liquid run-off disposal system as defined in claim 1, wherein the tank structure has an end wall at each end, in use, so as to form an enclosed below-ground tank or tunnel.

7. The liquid run-off disposal system as defined in claim 1, wherein each culvert section has a rounded top having a curvature.

8. The liquid run-off disposal system as defined in claim 1, wherein each culvert section has an open base.

9. The liquid run-off disposal system as defined in claim 1, wherein each culvert section has interlocking edges provided at each end adapted to interlock with an adjoining culvert section.

10. The liquid run-off disposal system as defined in claim 1, wherein concrete footings for the culvert sections are provided in an excavated trench prior to installation of the liquid run-off disposal system where it would be subject to heavy vehicular traffic.

11. The liquid run-off disposal system as defined in claim 1, further comprising one or more vertical liners arranged at predetermined locations on top of the culvert sections to provide access to the tank structure for maintenance purposes.

12. The liquid run-off disposal system as defined in claim 11, wherein each liner is provided with a manhole cover or a grating for back-pressure relief and to collect stormwater from sealed surfaces other than a building.

13. The liquid run-off disposal system as defined in claim 1, wherein each culvert section further comprises one or more vertically oriented elongate drain pipes which are mounted inside each culvert section.

14. The liquid run-off disposal system as defined in claim 13, wherein each drain pipe is of hollow cylindrical cross-section and has a top end and a bottom end with an opening at the bottom end which connects to a drain hole provided in a floor of the culvert section.

15. The liquid run-off disposal system as defined in claim 14, wherein the opening at the bottom end of the drain pipe is provided with a one-way valve for inhibiting the reverse flow of liquid through the drain hole back into the culvert section.

16. The liquid run-off disposal system as defined in claim 14, wherein each drain pipe is provided with a series of apertures at spaced intervals about its circumference and along its length whereby, in use, any liquid which accumulates in the culvert section is allowed to drain away in a controlled manner through the drain hole in the floor of the culvert section.

17. The liquid run-off disposal system as defined in claim 16, wherein the culvert section is a drainage soakwell or gully pit in a car park area of a development with the stormwater cylindrical tanks system installed between vertical liners.

18. The liquid run-off disposal system as defined in claim 1, wherein the side walls are parallel to one another.

19. The liquid run-off disposal system as defined in claim 18, wherein for each aperture the distance between the upper surface and the lower surface at the inner surface is the same so that each of the apertures have substantially the same height at the inner surface.

* * * * *